US010041490B1

(12) United States Patent
Jahnke

(10) Patent No.: US 10,041,490 B1
(45) Date of Patent: Aug. 7, 2018

(54) QUICK CHANGE CYLINDRICAL LINER RETAINER ASSEMBLY

(71) Applicant: PREMIUM OILFIELD TECHNOLOGIES, LLC, Houston, TX (US)

(72) Inventor: Douglas Jahnke, Houston, TX (US)

(73) Assignee: PREMIUM OILFIELD TECHNOLOGIES, LLC, Houston, TX (US)

( * ) Notice: Subject to any disclaimer, the term of this patent is extended or adjusted under 35 U.S.C. 154(b) by 195 days.

(21) Appl. No.: 15/273,019

(22) Filed: Sep. 22, 2016

Related U.S. Application Data

(60) Provisional application No. 62/233,018, filed on Sep. 25, 2015.

(51) Int. Cl.
*F04B 53/16* (2006.01)

(52) U.S. Cl.
CPC ..... *F04B 53/168* (2013.01)

(58) Field of Classification Search
CPC ..... F04B 53/168; F04B 53/166; F04B 53/22; F04B 53/126
USPC ..... 92/128
See application file for complete search history.

(56) References Cited

U.S. PATENT DOCUMENTS

2002/0124720 A1* 9/2002 Aday ..... F04B 15/02 92/171.1

* cited by examiner

*Primary Examiner* — Thomas E Lazo
*Assistant Examiner* — Daniel Collins
(74) *Attorney, Agent, or Firm* — Jackson Walker, LLP

(57) ABSTRACT

The present invention provides a quick change system and method for a cylindrical liner retainer assembly that includes a locking sleeve and lock dogs to release quickly an existing cylinder liner in the assembly and install a replacement cylinder liner in the assembly.

12 Claims, 10 Drawing Sheets

QUICK CHANGE CYLINDRICAL LINER RETAINER ASSEMBLY

CROSS REFERENCE TO RELATED APPLICATIONS

This application claims the benefit of U.S. Provisional Application No. 62/233,018, filed Sep. 25, 2015, which is incorporated by reference herein.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

The disclosure relates generally to equipment used with liner and retainers in cylindrical cavities. More specifically, the disclosure relates to a cylindrical liner retainer, such as for pumps.

Description of the Related Art

The efficiency of maintenance on equipment such as oilfield equipment can have a dramatic impact on profitability. A faster repair and restart of operation can be valuable. One area of need is to change quickly a cylindrical liner retainer assembly in equipment that repeatedly wears out such liners.

FIG. 1 is a schematic perspective view of an exemplary known pump assembly having power end and fluid end. FIG. 2 is a schematic cross sectional view of the known pump assembly of FIG. 1. FIG. 3 is a schematic cross sectional perspective view of the known fluid end of FIG. 2 with a replaceable cylinder liner and associated components to retain in position. FIG. 4 is a schematic assembly view of the cylinder liner with the liner bushing and liner nut shown in FIG. 3. The pump assembly 2 generally includes a power end 4 coupled with a fluid end 6. The power end 4 can include an engine, motor, or other prime mover. The fluid end can include inlets, outlets, valves, and flow paths. A piston rod assembly 8 couples the power end 4 with the fluid end 6 and reciprocates within a cylinder liner 12 held in position by a liner bushing 14 and coupled to a fluid end portion 16 with a liner nut 22. The piston reciprocation within the cylinder liner alternatively pulls fluid into the pump end 6 from an inlet 18 and then pushes the fluid through the pump end out of the outlet 20.

The life of a typical chrome iron liner in an oil field pump can be 1000 hours or less. To install a replacement cylinder liner at normal operating pressures and size of an oil field pump, a service person usually needs to exert 4000 foot-pounds of torque on the liner nut 22. This large amount of torque is equivalent to a 150 pound service person hanging with the person's full weight onto a 27 foot long pipe attached to the liner nut to create the torque. Typically, rods or pipes and large hammers are used to turn the liner nut 22 to the required torque, inviting accidents and injuries. The reverse procedure can be applied to remove the liner nut. After the liner nut is removed, the cylinder liner is removed often with an adaptor to connect to the piston positioned within the cylinder liner and an external groove on the cylinder liner and then the piston is retracted away from the fluid end toward the power end to remove the liner with the piston. After replacement of the cylinder liner, the liner nut again needs to be torqued to 4000 foot-pounds in such applications. Other applications may vary in the torque requirements.

There remains a need for an improved cylinder liner assembly that can be used to install and remove the cylinder liner. The present invention offers such a solution.

BRIEF SUMMARY OF THE INVENTION

The present invention provides a quick change system and method for a cylindrical liner retainer assembly that includes a locking sleeve and lock dogs to release quickly an existing cylinder liner in the assembly and install a replacement cylinder liner in the assembly.

The disclosure provides a cylinder liner retainer assembly for a pump with a fluid end portion having a piston to reciprocate longitudinally along a centerline within a cylinder liner coupled to the assembly, comprising: a liner housing having an outer periphery formed with threads and a longitudinal bore forming a wall therebetween, the liner housing having a portion configured to attach to the fluid end portion, the liner housing further comprising a lock dog opening formed through the wall; a lock dog having a groove formed on an inner surface of the lock dog, the lock dog configured to slidably engage the lock dog opening in the liner housing; a collar nut having a longitudinal bore larger than the liner housing outer periphery, the collar nut bore having first threads and second threads, the first threads being configured to threadably engage the liner housing threads; a locking sleeve having an outer periphery smaller than at least a portion of the collar nut bore and a longitudinal bore larger than the liner housing outer periphery, the locking sleeve having threads on the outer periphery configured to engage the second threads of the collar nut, and the locking sleeve bore having an inner longitudinally tapered surface configured to slidably engage an outer surface of the lock dog; and an adapter ring having a longitudinal bore larger than an outer periphery of at least a portion of the cylinder sleeve and an outer groove configured to engage the lock dog groove.

The disclosure also provides a method of installing a cylinder liner for a piston in a pump, the pump having a cylinder liner retainer assembly with a liner housing formed with a bore and coupled to a fluid end portion of the pump; a lock dog slidably engaged with the liner housing, a collar nut having a bore and extending longitudinally at least partially around the lock dog and the liner housing; a locking sleeve extending longitudinally at least partially between an inner periphery of the collar nut and an outer periphery of the lock dog formed by the lock dog being slidably engaged with the liner housing and having a locking sleeve bore with an inner longitudinally tapered surface configured to slidably engage the outer periphery of the lock dog; and an adapter ring extending longitudinally at least partially between an inner periphery of the lock dog formed by the lock dog being slidably engaged with the liner housing and an outer periphery of the cylinder liner, the method comprising: inserting the cylinder liner into the bore of the liner housing; inserting the adapter ring over the cylinder liner and into the bore of the liner housing until longitudinally positioned under the lock dog; rotating the collar nut in a rotational first direction to move the tapered surface of the locking sleeve longitudinally along the outer periphery of the lock dog to slide the lock dog toward the adapter ring; engaging the lock dog with the adapter ring with an angled surface; and pushing the adapter ring longitudinally toward the cylinder liner and toward the liner housing.

DETAILED DESCRIPTION

Figure 1:
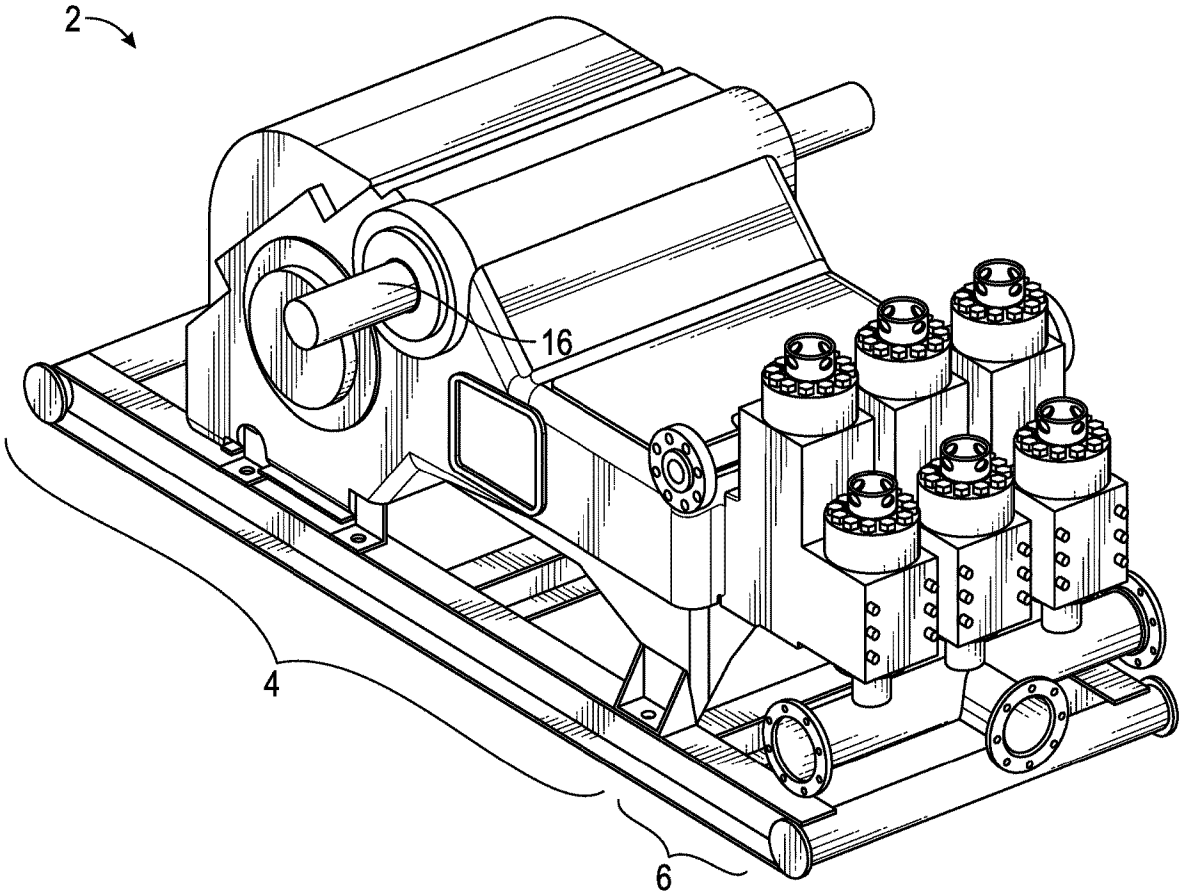
FIG. 1 (Prior Art)
FIG. 1 is a schematic perspective view of an exemplary known pump assembly having power end and fluid end.
Figure 2:
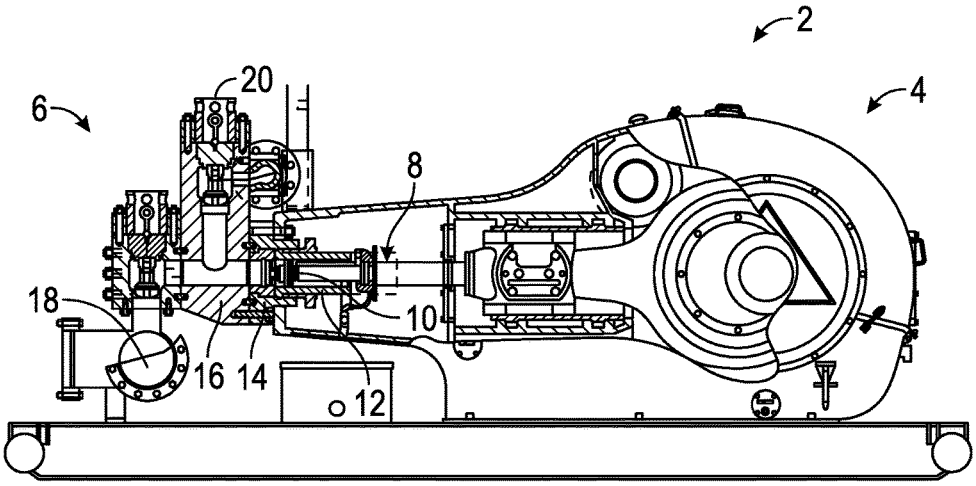
FIG. 2 (Prior Art)
FIG. 2 is a schematic cross sectional view of the known pump assembly of FIG. 1.
Figure 3:
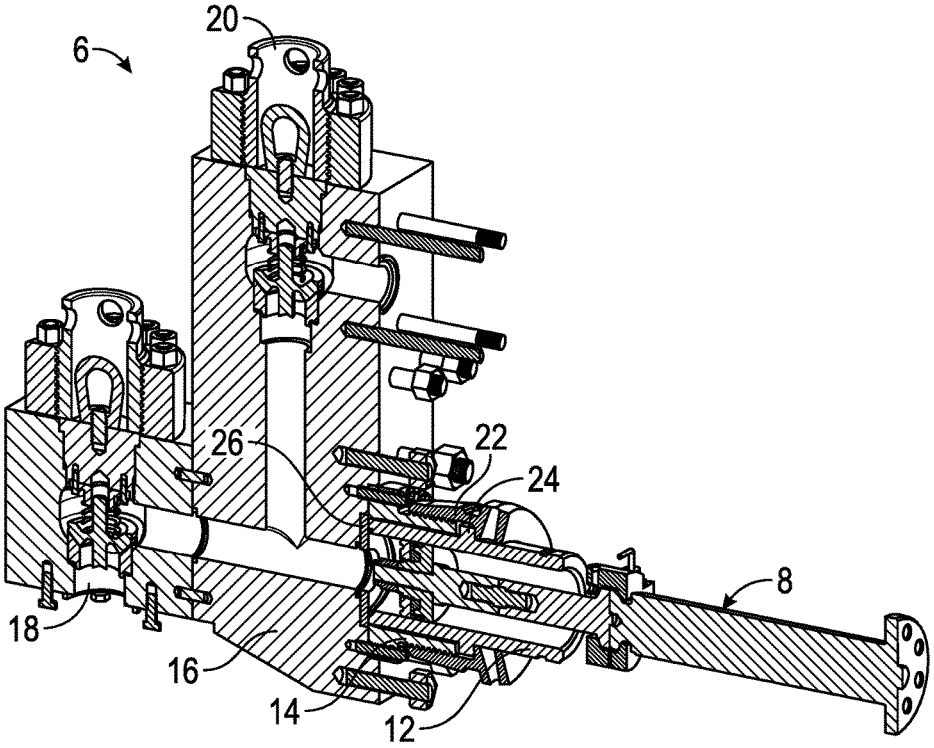
FIG. 3 (Prior Art)
FIG. 3 is a schematic cross sectional perspective view of the known fluid end of FIG. 2 with a replaceable cylinder liner and associated components to retain in position.

The Figures described above and the written description of specific structures and functions below are not presented to limit the scope of what Applicant has invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related, and other constraints, which may vary by specific implementation, location, and from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms. The use of a singular term, such as, but not limited to, "a," is not intended as limiting of the number of items. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the term "comprise" or variations such as "comprises" or "comprising," should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The term "inner," "inward," "internal" or like terms refers to a direction facing toward the longitudinal centerline of an assembly, such as the cylinder liner retainer assembly, or component having a longitudinal centerline and the term "outer," "outward," "external" or like terms refers to a direction facing away from the longitudinal centerline. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The present invention provides a quick change system and method for a cylindrical liner retainer assembly that includes a locking sleeve and lock dogs to release quickly an existing cylinder liner in the assembly and install a replacement cylinder liner in the assembly.

Figure 4:
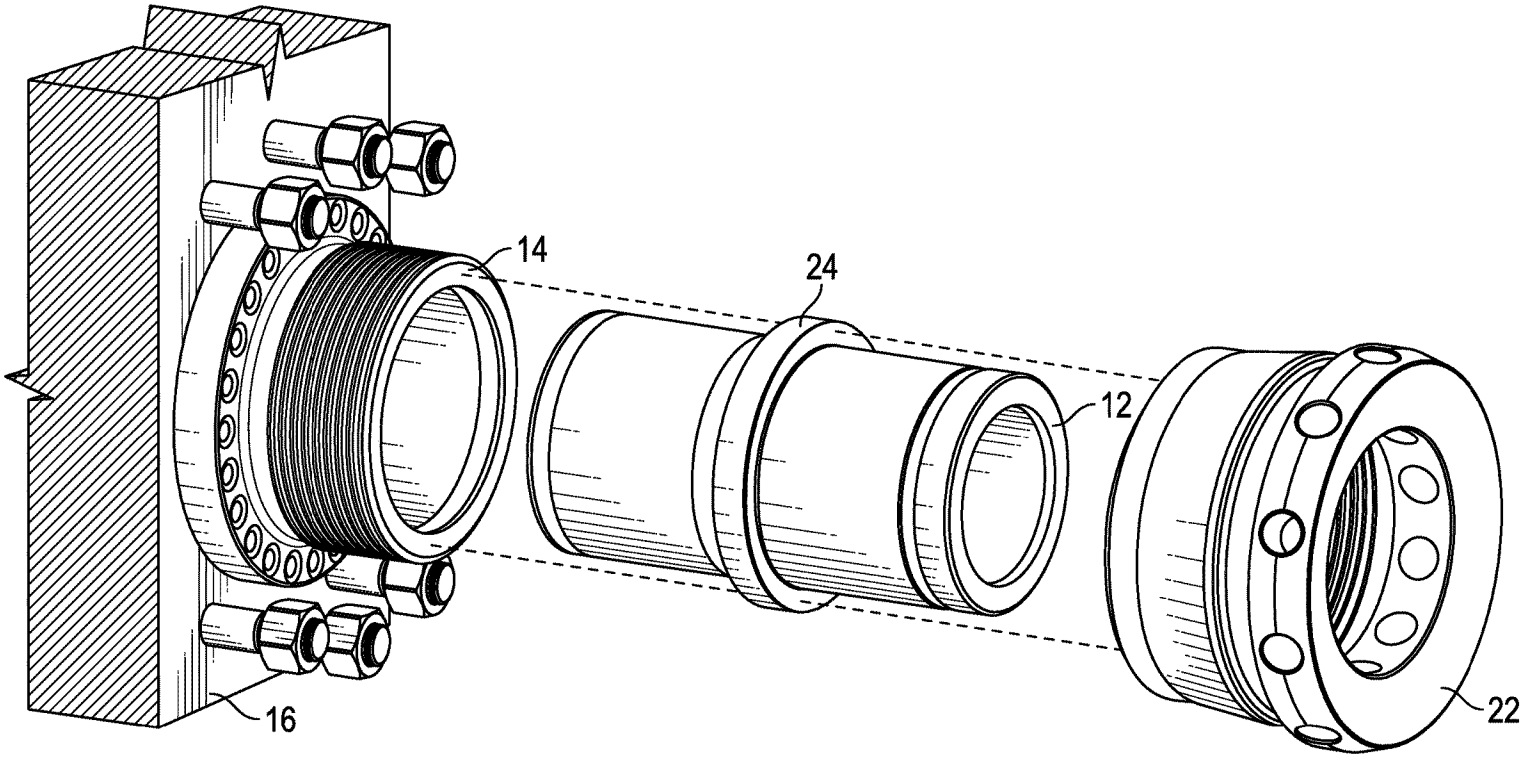
FIG. 4 (Prior Art)
FIG. 4 is a schematic assembly view of the cylinder liner with the liner bushing and liner nut shown in FIG. 3.
Figure 5:
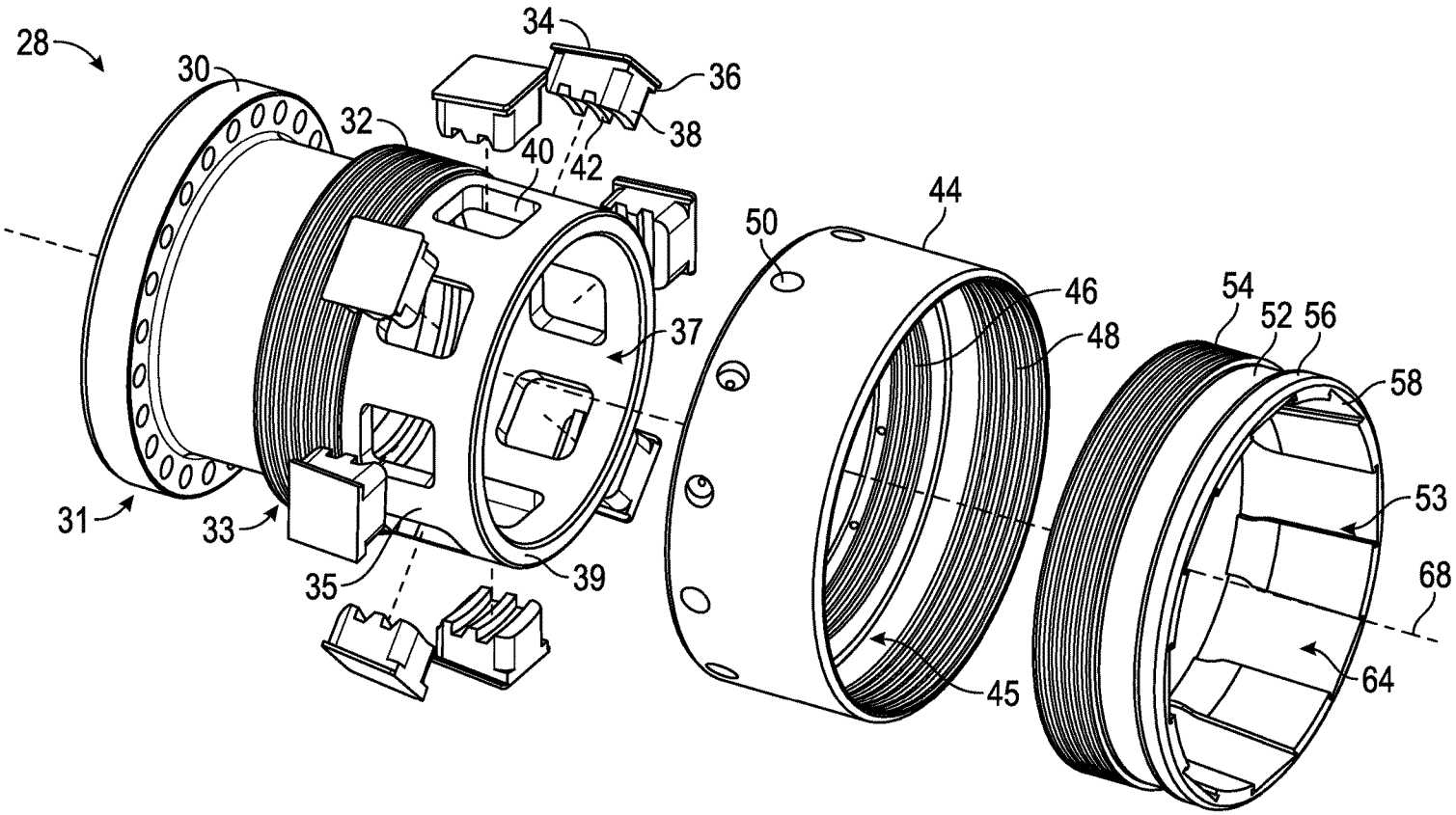
FIG. 5 is a schematic perspective assembly view of cylinder liner retainer assembly according to the present invention.
Figure 6:
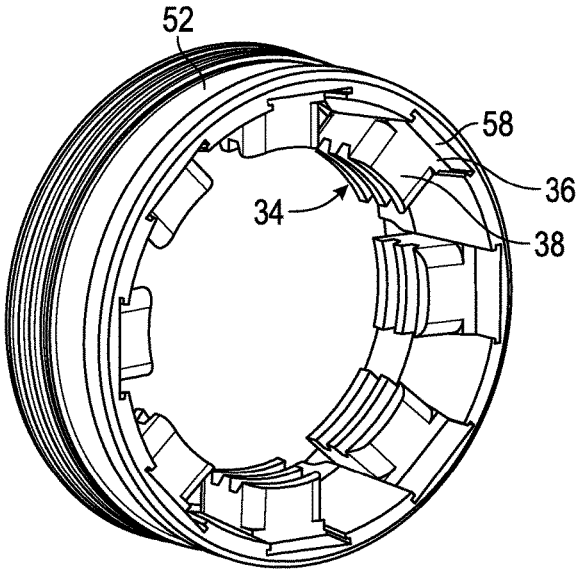
FIG. 6 is a schematic perspective view of a locking sleeve coupled with a set of lock dogs.
Figure 8:
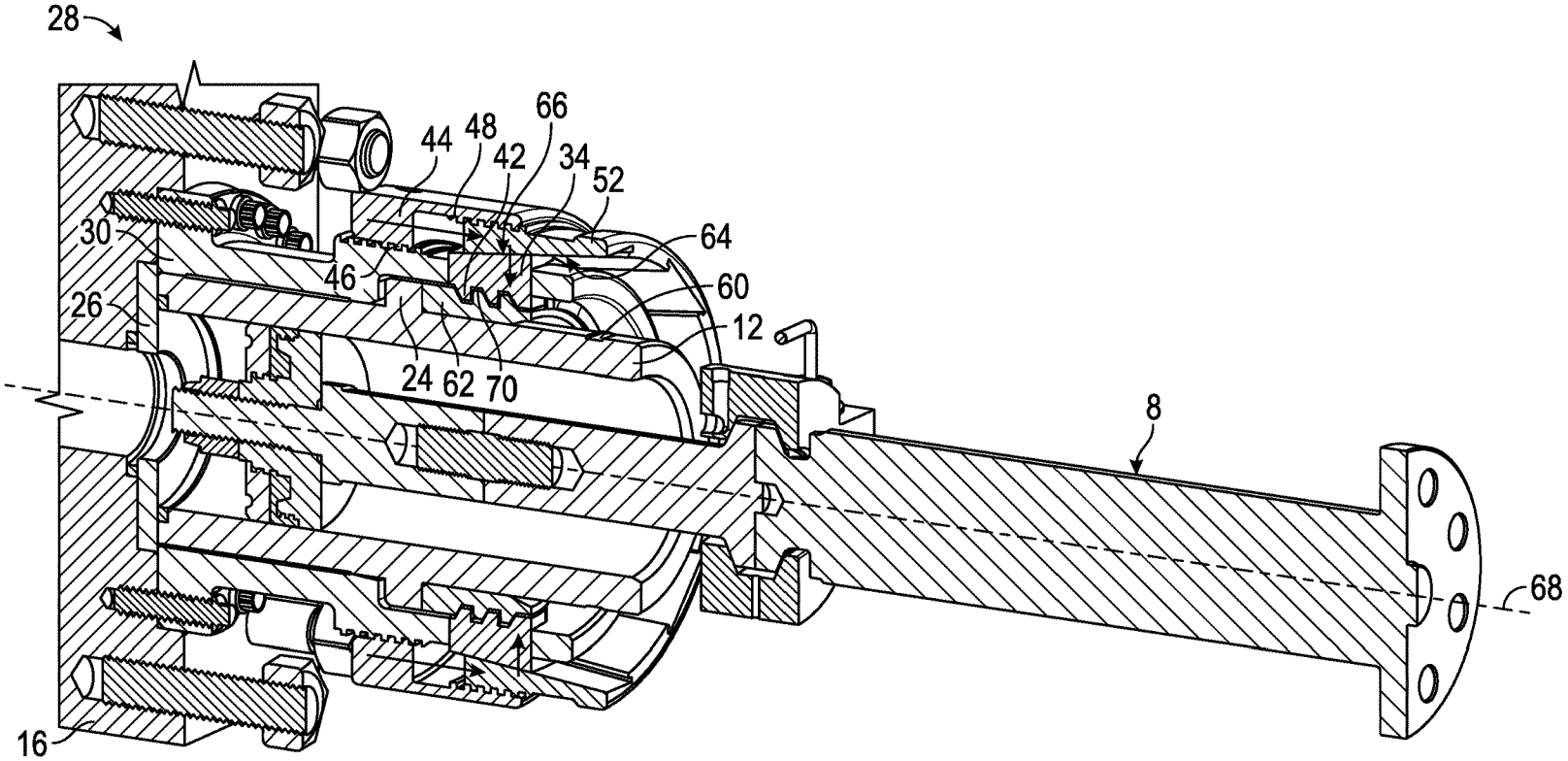
FIG. 8 is a schematic perspective view of the cylinder liner retainer assembly with the cylinder liner and the piston rod assembly.

FIG. 5 is a schematic perspective assembly view of cylinder liner retainer assembly according to the present invention. FIG. 6 is a schematic perspective view of a locking sleeve coupled with a set of lock dogs. The cylinder liner retainer assembly 28 is configured to attach to the fluid end portion 16 of the fluid end 6 described in the above FIGS. 1-4 and hold the cylinder liner 12 in position for the piston rod assembly 8 to longitudinally reciprocate therein, such as shown in FIG. 8. The cylinder liner retainer assembly 28 provides an improvement over the prior art liner bushing 14 and liner nut 22 described in FIG. 4.

Figure 7:
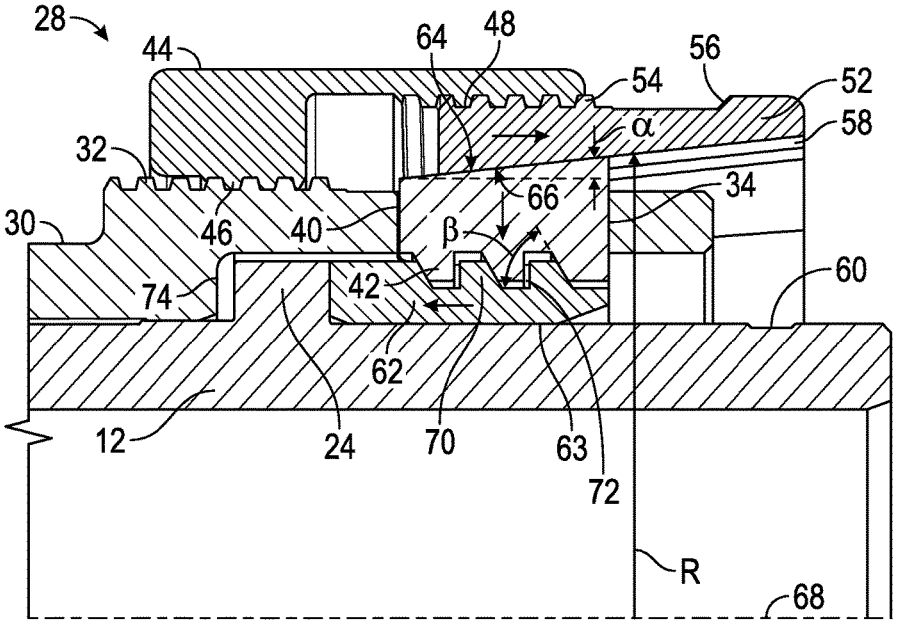
FIG. 7 is a schematic cross sectional detailed side view of the lock dogs of the cylinder liner retainer assembly engaged with the cylinder liner.

In at least one embodiment, the cylinder liner retainer assembly 28 includes a liner housing 30, a collar nut 44, a locking sleeve 52, and an adapter ring 62 (shown in FIG. 7). The liner housing 30 is configured on a first portion 31, for example with a series of openings, to couple the liner housing to the fluid end portion 16, shown in FIGS. 2-4. A liner housing wall 39 is formed between an outer periphery 35 and a liner housing bore 37. One or more helically twisting threads 32 are formed on the outer periphery 35. The term "threads" is used broadly to refer to a single thread that helically circumscribes a surface at least once or a series of separate threads that collectively circumscribe a surface at least once.

The liner housing 30 includes a second portion 33 having one or more of lock dog openings 40 formed through the wall 39 of the liner housing and sized to allow one or more lock dogs 34 to be inserted therein and slidably engage the openings. The lock dog 34 includes a head 36 and a body 38. The head is wider than the body 38 and can form a cross-sectional "T' shape from an end view. The bottom of the lock dog that faces radially inward when assembled in the lock dog opening 40 includes one or more grooves 42 that can engage the adapter ring 62 described below. The top of the lock dog that faces radially outward when assembled in the lock dog opening 40 can include a longitudinally tapered surface 64, shown in FIG. 7.

A collar nut 44 is sized to allow the outer periphery of the liner housing 30 and lock dogs 34 to pass within a bore 45 of the collar nut, so that at least a portion of the collar nut bore is larger than the liner housing outer periphery. An end of the collar nut 44 proximal to the liner housing 30 includes one or more internal helical threads 46 formed with a pitch to rotationally engage the outer peripheral liner housing threads 32. In at least one embodiment, the threads 32 and threads 46 can be left-hand threads. A second end of the collar nut 44 can include a second set of helical internal collar nut threads 48. The internal collar nut threads 48 are formed with the pitch to rotationally engage a corresponding set of external threads 54 on the locking sleeve 52, described below. In at least one embodiment, the threads 48 and threads 54 can be right-hand threads. Further, the collar nut includes one or more radial openings 50 into which a bar, pipe, spanner wrench, or other similar tool can be inserted to rotate the collar nut around the threads 32 of the liner housing 30.

A locking sleeve 52 with a longitudinal bore 53 can include a set of external helical threads 54 on an outer periphery formed with the pitch to rotationally engage the internal collar nut threads 48 on the collar nut 44. The locking sleeve 52 further includes a shoulder 56 configured to restrain the longitudinal movement of the collar nut 44 when rotated toward the end of the locking sleeve 52 with the shoulder. The locking sleeve 52 can further include an internal "T" slot 58 formed along the inner surface of the bore of the sleeve to accept the corresponding T shape of the lock dog 34. The locking sleeve 52 can include an inner longitudinally tapered surface 64, such as can be formed along the surface of the T-slot groove 58, in the bore and configured to slidably engage an outer surface of the lock dog 34. Thus, the lock dog 34 can slide longitudinally in the T slot 58 of the locking sleeve 52 while being constrained in radial movement (inward or outward) depending on the sliding engagement with the longitudinally tapered surface 64.

FIG. 7 is a schematic cross sectional detailed side view of the lock dogs of the cylinder liner retainer assembly engaged with the cylinder liner. Starting from the left side of FIG. 7, the cylinder liner retainer assembly 28 includes the liner housing 30 having external threads 32 and an opening 40 to accept the lock dog 34 therethrough. The collar nut 44 is threaded onto the liner housing 30, so that the threads 46 of the collar nut engage the threads 32 of the liner housing 30. The locking sleeve 52 in turn is threaded into the collar nut 44, so that the threads 48 on the collar nut are engaged with the threads 54 of the locking sleeve. As the collar nut 44 is rotated, the locking sleeve 52 moves longitudinally. The longitudinal tapered surface 64 inside the bore of the locking sleeve 52 can engage an external longitudinally tapered surface 66 on the lock dog 44. As the locking sleeve moves longitudinally, the engagement of the tapered surfaces between the locking sleeve and the lock dog affects the radial distance of the lock dog and its engagement with an adapter ring 62. The adapter ring 62 has a bore 63 larger than an outer periphery of at least a portion of the cylinder sleeve 12 and can engage the external shoulder 24 of the cylinder liner to press against an internal shoulder 74 on the liner housing 30. The lock dog 34 is slidably mounted in the T slot 58 of the locking sleeve 52, so that the lock dog radial location is controlled by the longitudinal position of the locking sleeve and the radial distance R of the engagement of the tapered surfaces 64 and 66. An angle "$\alpha$" of one or both the tapered surfaces measured from a line parallel with the longitudinal centerline 68 can vary between greater than 0° and equal to or less than 45° (that is, $0° < \alpha 45°$), and any increment, including decimal increments, therebetween. In at least one embodiment, the tapered surfaces can range from greater than 0° to equal to or less than 45°, and in another embodiment, can range from 2° to 15° inclusive, and yet further from 3° to 10° inclusive.

The adapter ring 62 in turn has corresponding grooves 70 to engage with the lock dog grooves 42. As the lock dog grooves 42 engage the adapter ring grooves 70, the angle "$\beta$" of the grooves measured from a line parallel with the longitudinal centerline 68 causes the adapter ring 62 to move longitudinally. A gap 72 can be formed between the grooves 42 and 70 to allow for tolerances and wear. If the cylinder liner 12 is being tightened to the liner housing 30, the adapter ring 62 moves to engage a shoulder 24 on the cylinder liner 12 to press the shoulder against the liner housing 30, preferably with a seal therebetween. The angle $\beta$ of the grooves can vary from equal to or greater than 45° and less than 90° (that is, $45° \beta < 90°$), °), and any increment, including decimal increments, therebetween. In at least one embodiment, the tapered surfaces can range from greater than 45° to equal to 75°, and in another embodiment, can range from 50° to 70° inclusive, and yet further from 55° to 65° inclusive. The angle $\alpha$ and angle $\beta$ each separately and synergistically together provide a mechanical advantage of one or more inclined planes to reduce the amount of torque required on the collar nut 44 to produce an equivalent contact pressure on the cylinder liner 12 to engage the liner housing 30. By comparison, the 4000 foot-pounds of torque referenced in the background portion of the specification can be reduced in at least one embodiment to about 600 foot-pounds of torque.

In at least one embodiment, the threads 32 and 46 can be left-hand threads, and the threads 48 and 54 can be right-hand threads. As the collar nut 44 is rotated in a rotational first direction, the collar nut progresses in a longitudinal direction relative to the fixed position of the liner housing 30, while the locking sleeve 52 progresses in the same direction relative to the collar nut 44, so that the locking sleeve moves faster relative to the liner housing than the collar nut. The increased relative movement by the opposite hand threads causes the lock dog 34 to move radially more quickly to engage and disengage the adapter ring 62 and therefore move the adapter ring more quickly longitudinally. In other embodiments, the left-hand and right-hand threads can be reversed, and in other embodiments 44 can be fixed axially while able to rotate, and connected by one thread (left-hand or right-hand) to 52 for slower longitudinal movement of the locking sleeve.

Figure 9:
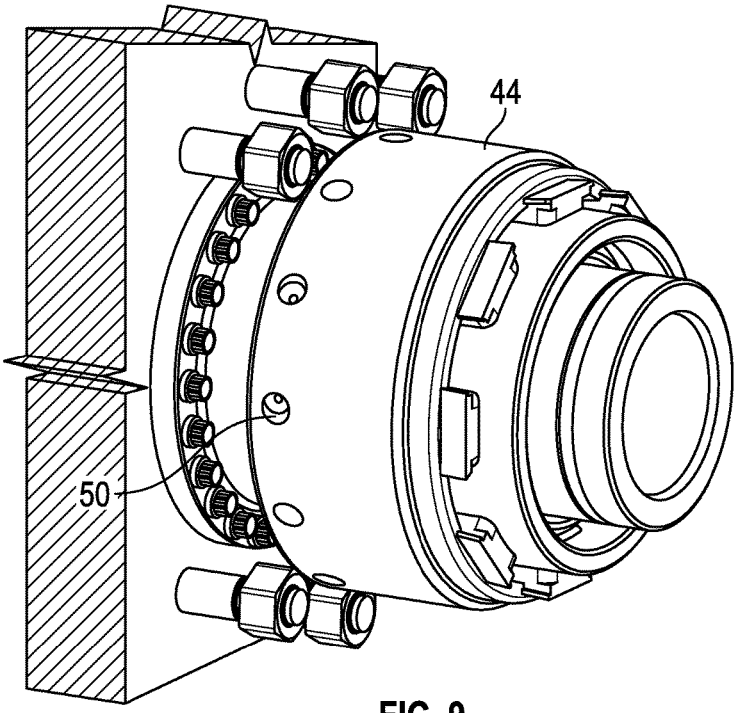
FIG. 9 is a schematic perspective view of the collar nut with a set of torque openings former therein.

FIG. 8 is a schematic perspective view of the cylinder liner retainer assembly with the cylinder liner and the piston rod assembly. FIG. 9 is a schematic perspective view of the collar nut with a set of torque openings former therein. The cylinder liner retainer assembly 30 is shown coupled with the fluid end portion 16 through various fasteners including bolts and nuts. A wear plate 26 is disposed in a recess of the fluid end portion 16. The liner housing 30 of the cylinder liner retainer assembly 28 is coupled to the fluid end portion 16. The collar nut 44 having threads 46 is rotatably coupled with corresponding threads on the liner housing 30. Threads 48, generally on a distal end of the collar nut 44, are rotatably coupled to a set of corresponding threads on the locking sleeve 52. The locking sleeve 52 has a tapered surface 64 that is slidably engaged with a mating tapered surface 66 on the lock dog 34. The lock dog 34 is constrained in longitudinal and circumferential movement by an opening formed in the liner housing 30, but can move radially inward or outward from the centerline 68 of the cylinder liner retainer assembly 30. An adapter ring 62 is matingly engaged with one or more grooves 42 on the lock dog 34, where the grooves have an angled contact surface. As the collar nut 44 is turned rotationally in a direction, the locking sleeve 52 moves longitudinally. As the locking sleeve 52 moves longitudinally, the relative position of the tapered surfaces 64 and 66 change, so that the lock dog moves radially inwardly or outwardly, depending on the direction of the collar nut rotation. As the lock dog 34 moves radially inward, the angled surface of the lock dog grooves 42 presses against the corresponding angled grooves 70 of the adapter ring 62 and pushes the adapter ring toward the shoulder 24 on the cylinder liner 12 to engage the cylinder liner 12 against the liner housing 30. The collar nut torque openings 50 that are circumferentially spaced about the outer periphery of the collar nut 44 can be used to insert a tool for leverage in rotating the collar nut 44 around the liner housing 30. In the embodiment shown, the threads 46 are left-hand and the threads 48 are right-hand. By rotating the collar nut 44 in a clockwise direction viewed from the piston end of the cylinder liner, the collar nut 44 moves relative to the liner housing 30 away from the fluid end portion 16 and the locking sleeve 52 moves away from the collar nut 44. Thus, the combination of the left-hand threads 46 and right-hand threads 48, and their corresponding threads on the liner housing and locking sleeve, causes the locking sleeve 52 to move faster relative to the liner housing than if the threads were both left-hand or right-hand. The tapered surfaces 64 and 66 change their respective position correspondingly and the lock dog 34 moves radially inward to engage and move the adapter ring 62 against the cylinder liner shoulder 24.

Figure 10:
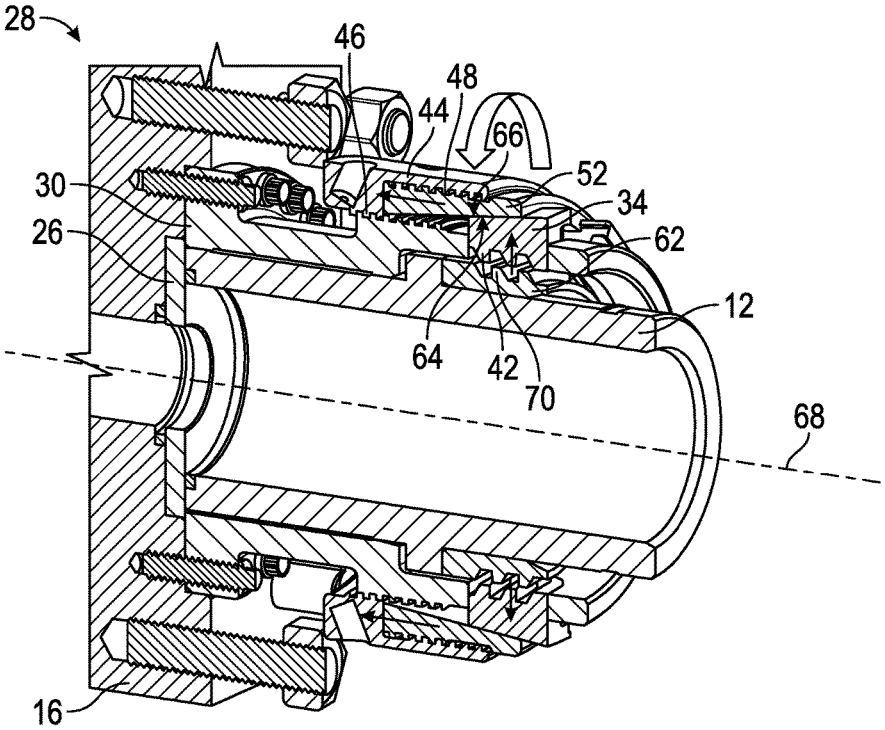
FIG. 10 is a schematic perspective side view of the lock dogs of the cylinder liner retainer assembly disengaged with the cylinder liner.
Figure 11:
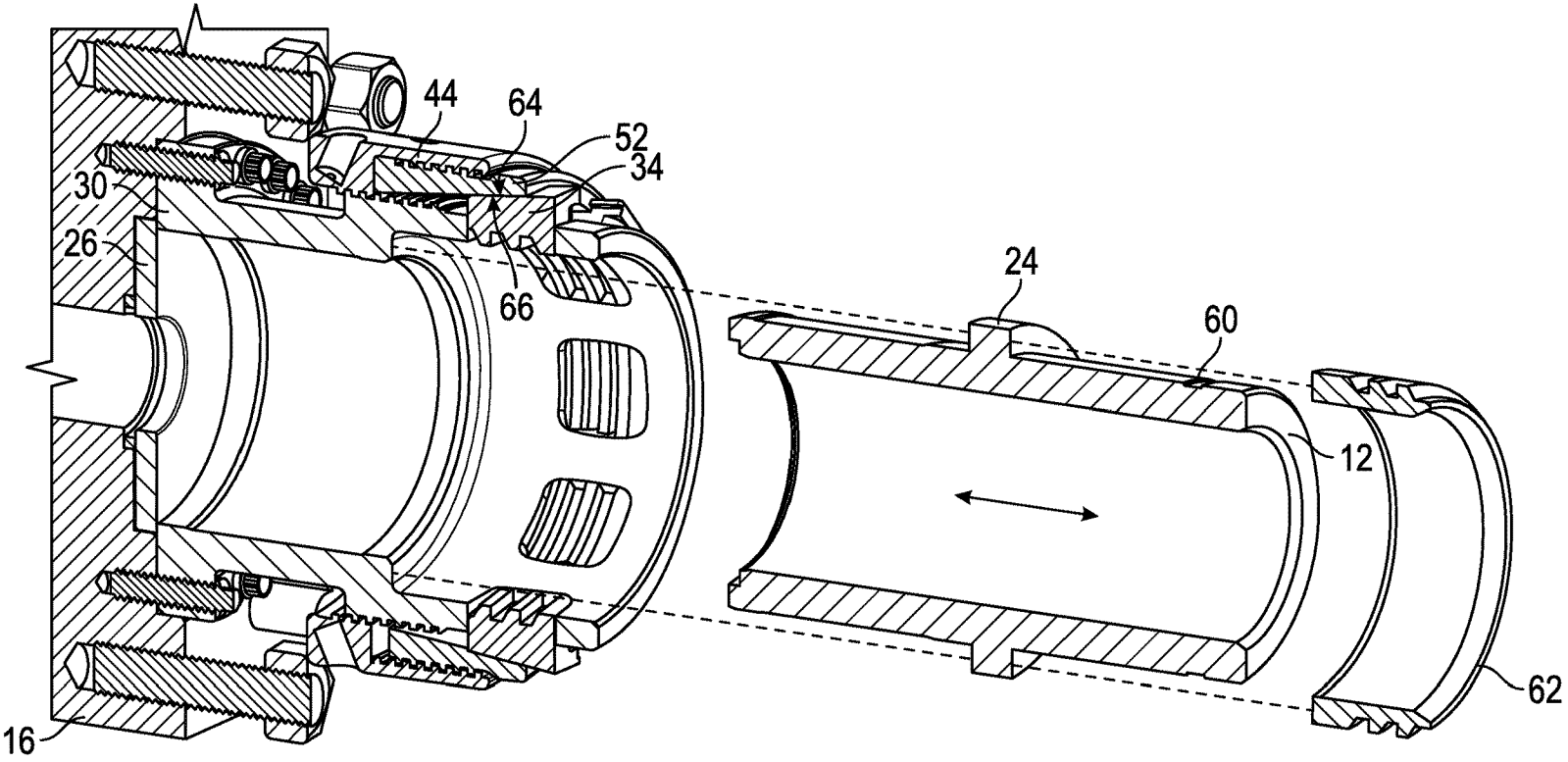
FIG. 11 is a schematic perspective side view of the cylinder liner removed from the fluid end manifold and the cylinder liner retainer assembly.

FIG. 10 is a schematic perspective side view of the lock dogs of the cylinder liner retainer assembly disengaged with the cylinder liner. FIG. 11 is a schematic perspective side view of the cylinder liner removed from the fluid end portion and the cylinder liner retainer assembly. To release the cylinder liner 12 from the liner housing 30, the collar nut 44 can be rotated in the opposite direction as described in FIGS. 8 and 9 above (such as counterclockwise as viewed from the end of the cylinder liner). The reverse movement longitudinally pulls the locking sleeve 52 closer to the collar nut 44, while the collar nut moves closer to the fluid end portion 16 in this embodiment. The longitudinal movement of the locking sleeve 52 results in a smaller cross-section of the adapter ring 62 engaging the lock dog 34, so that a radial distance of the engagement is farther away from centerline 68, which in turn pulls the lock dog 34 radially away from the adapter ring 62. The cylinder liner 12 can then be removed and replaced.

In some embodiments, it may be useful to use a removal tool (not shown) that can be coupled around an outer periphery of the cylinder liner 12 at a liner groove 60 and around the piston rod assembly 8, shown in FIG. 8. By retracting the piston rod assembly 8 away from the fluid end portion 16, the piston rod assembly can longitudinally pull the cylinder liner 12 out of the liner housing 30. The adapter ring 62 can be pulled out of the liner housing 30 with the cylinder liner 12. A new cylinder liner 12 can be inserted in the liner housing 30 and the adapter ring 62 inserted over the cylinder liner, so that the grooves in the adapter ring 62 can align with the grooves in the lock dog 34. The collar nut 44 can then be retightened so that the grooves of the lock dog 34 engage the adapter ring 62, and the adapter ring pushes the cylinder liner 12 into firm contact with the liner housing 30.

Figure 12:
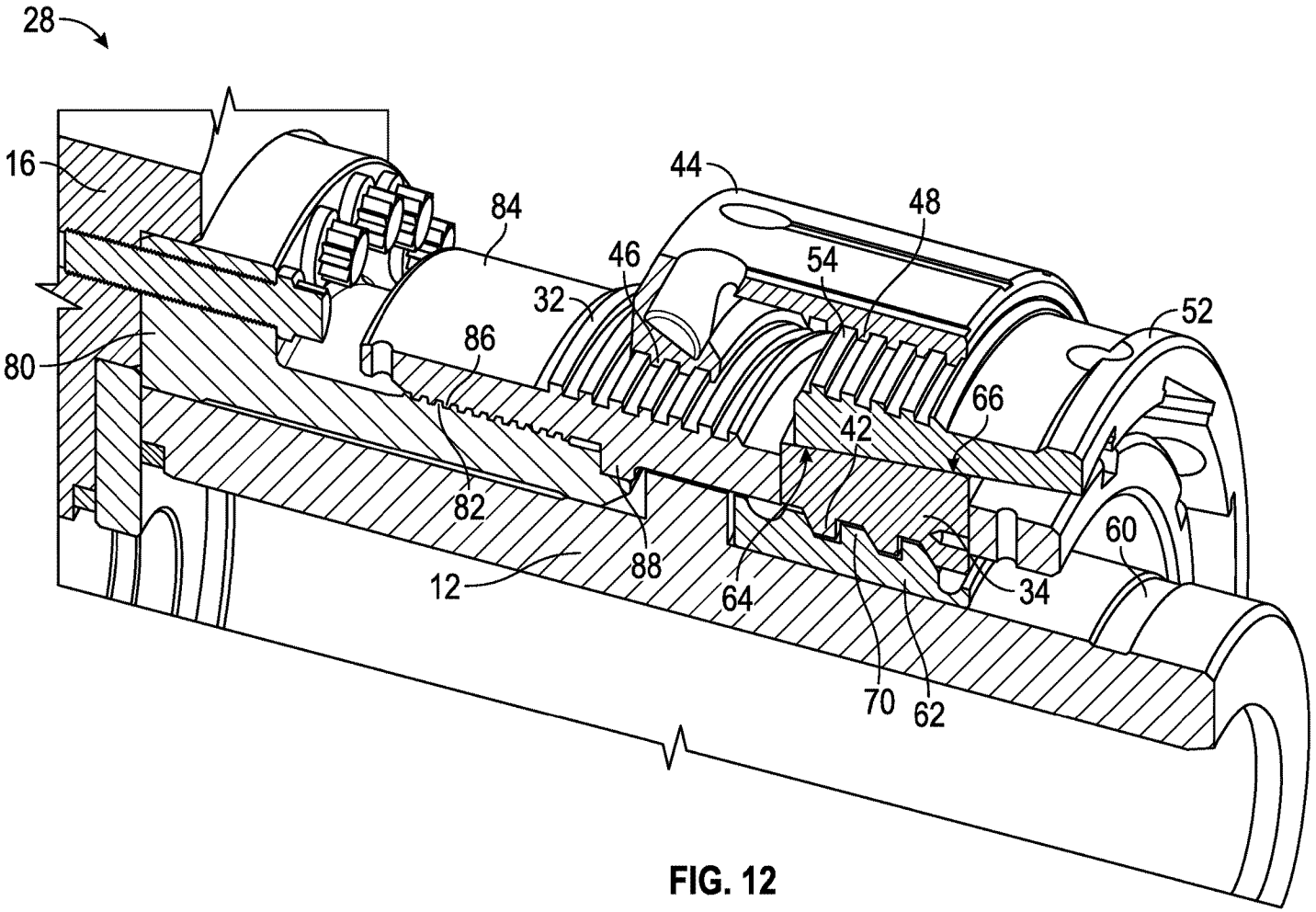
FIG. 12 is a schematic perspective view of another embodiment of the cylinder liner retainer assembly with the lock dogs engaged with adapter ring.

FIG. 12 is a schematic perspective view of another embodiment of the cylinder liner retainer assembly with the lock dogs engaged with the adapter ring. In this embodiment, the liner housing 30 described above has been separated into multiple components. In this embodiment, the liner housing is separated into a liner bushing 80 and a housing 84 coupled to the liner bushing. The liner bushing 80 can be attached to the fluid end portion 16. A distal end of the liner bushing 80 is formed with helical threads 82. The housing 84 can be formed with mating helical threads 86 to engage the helical threads 82 of the liner bushing 80. A shoulder 88 on the housing 84 can be used to locate the housing 84 relative to the liner bushing 80 in a longitudinal direction and preferably pressed against the liner bushing 80. The housing 82 can include threads 32 to engage corresponding threads 46 on the collar nut 44, as has been described above. Other component configurations can be made given the teachings herein that collectively make up the function of the described liner housing 30. The collar nut 44 is shown rotated, so that the locking sleeve 52 is longitudinally moved to where the tapered surfaces 64 and 66 of the locking sleeve 52 and the adapter ring 62 are engaged. Further movement causes the lock dog 34 to move the adapter ring 62 and press the cylinder liner 12 into position against the housing 84 and/or liner bushing 80.

Figure 13:
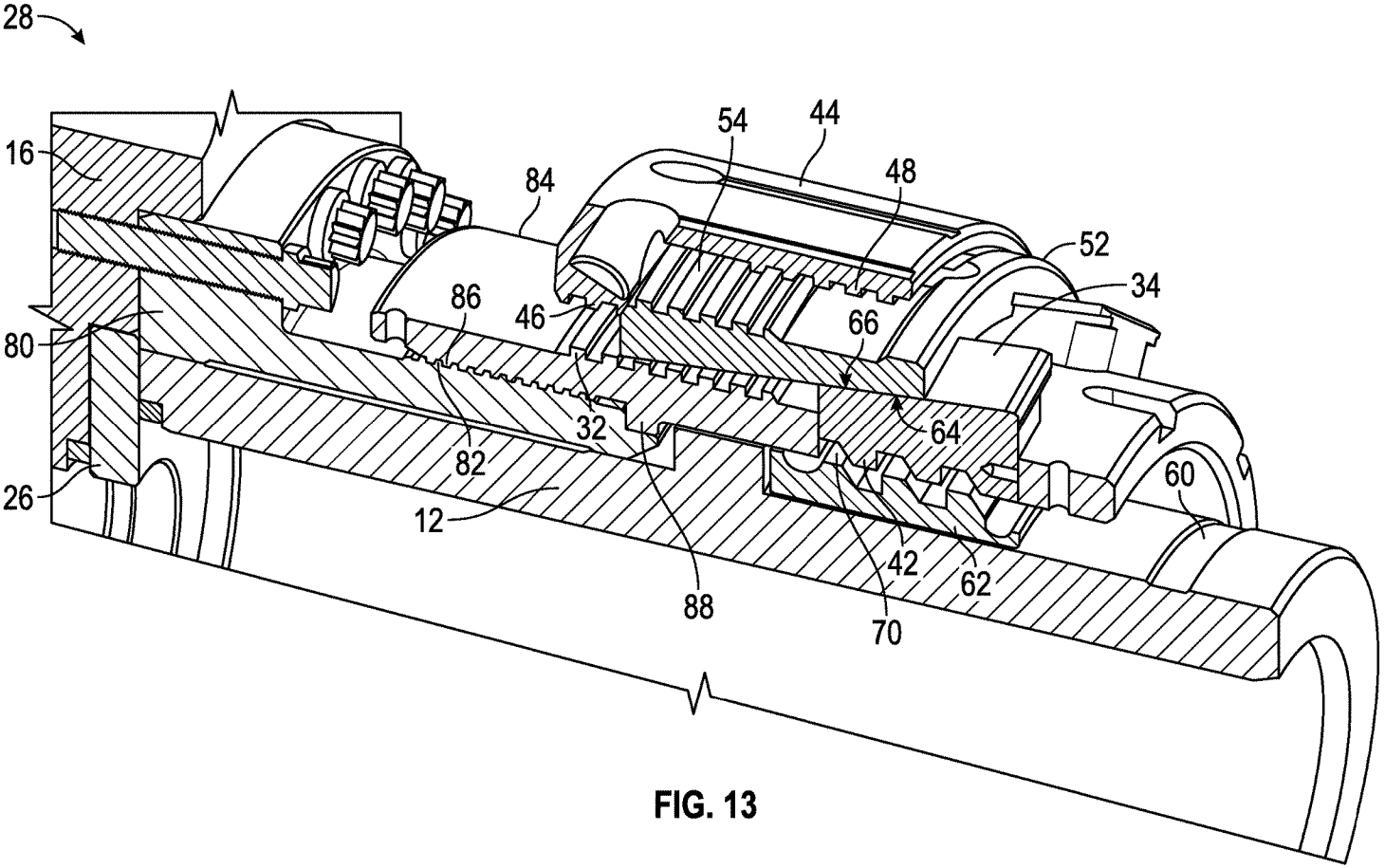
FIG. 13 is a schematic perspective view of the embodiment of the cylinder liner retainer assembly shown in FIG. 12 with the lock dogs disengaged from the adapter ring.

FIG. 13 is a schematic perspective view of the embodiment of the cylinder liner retainer assembly shown in FIG. 12 with the lock dog disengaged from the adapter ring. For disengagement, the collar nut 44 is rotated in an opposite direction from the tightening direction shown in FIG. 12. For example, the collar nut 44 is rotated to move longitudinally closer toward the engagement of the liner bushing 80 with the fluid end portion 16. The longitudinal movement causes the adapter ring 62 to retract longitudinally within the bore of the collar nut 44, which allows the lock dog 34 to move radially outward and disengage from the grooves 70 of the adapter ring 62. Once disengaged, the cylinder liner 12 can be removed from the liner bushing 80.

The invention has been described in the context of preferred and other embodiments and not every embodiment of the invention has been described. Obvious modifications include variations in the number of components that may be combined or separated into subcomponents, the number, shape, and size of the lock dogs, the number, shape, and size of the grooves between the lock dogs and the adapter ring, the direction of the helical twist in the threads, the shape of the slots in the locking sleeve, and other variations and associated methods of use and manufacture that an ordinary person skilled in the art would envision given the teachings herein. The disclosed and undisclosed embodiments are not intended to limit or restrict the scope or applicability of the invention conceived of by the Applicant, but rather, in conformity with the patent laws, Applicant intends to protect fully all such modifications and improvements that come within the scope or range of equivalents of the following claims.

What is claimed is:

1. A cylinder liner retainer assembly for a pump with a fluid end portion having a piston to reciprocate longitudinally along a centerline within a cylinder liner coupled to the assembly, comprising:

a liner housing having an outer periphery formed with threads and a longitudinal bore forming a wall therebetween, the liner housing having a portion configured to attach to the fluid end portion, the liner housing further comprising a lock dog opening formed through the wall;

a lock dog having a groove formed on an inner surface of the lock dog, the lock dog configured to slidably engage the lock dog opening in the liner housing;

a collar nut having a longitudinal bore larger than the liner housing outer periphery, the collar nut bore having first threads and second threads, the first threads being configured to threadably engage the liner housing threads;

a locking sleeve having an outer periphery smaller than at least a portion of the collar nut bore and a longitudinal bore larger than the liner housing outer periphery, the locking sleeve having threads on the outer periphery configured to engage the second threads of the collar nut, and the locking sleeve bore having an inner longitudinally tapered surface configured to slidably engage an outer surface of the lock dog; and an adapter ring having a longitudinal bore larger than an outer periphery of at least a portion of the cylinder sleeve and an outer groove configured to engage the lock dog groove.

2. The assembly of claim 1, wherein the lock dog comprises an outer longitudinally tapered surface configured to engage the inner longitudinally tapered surface of the locking sleeve.

3. The assembly of claim 1, wherein the lock dog has a head and a body, the head being wider than the body, and wherein the body is configured to slidably engage the lock dog head and slidably retain the body.

4. The assembly of claim 3, wherein the locking sleeve is formed with a slot configured to engage the head and slidably retain the body.

5. The assembly of claim 1, wherein the threads are helical threads.

6. The assembly of claim 1, wherein the liner housing comprises a liner bushing and a housing configured to be coupled to the liner bushing, the liner bushing being configured to attach to the fluid end portion and the housing having the lock dog opening.

7. The assembly of claim 1, wherein the liner housing threads and collar nut first threads have a helical twist in one direction and the collar nut second threads and locking sleeve threads have a helical twist in second direction different than the first direction.

8. The assembly of claim 7, wherein the liner housing threads and collar nut first threads are left-hand and the collar nut second threads and locking sleeve threads are right-hand.

9. The assembly of claim 1, wherein the second threads on the collar nut are a larger diameter than the first threads on the collar nut.

10. A method of installing a cylinder liner for a piston in a pump, the pump having a cylinder liner retainer assembly with a liner housing formed with a bore and coupled to a fluid end portion of the pump; a lock dog slidably engaged with the liner housing, a collar nut having a bore and extending longitudinally at least partially around the lock dog and the liner housing; a locking sleeve extending longitudinally at least partially between an inner periphery of the collar nut and an outer periphery of the lock dog formed by the lock dog being slidably engaged with the liner housing and having a locking sleeve bore with an inner longitudinally tapered surface configured to slidably engage the outer periphery of the lock dog; and an adapter ring extending longitudinally at least partially between an inner periphery of the lock dog formed by the lock dog being slidably engaged with the liner housing and an outer periphery of the cylinder liner, the method comprising:

inserting the cylinder liner into the bore of the liner housing;

inserting the adapter ring over the cylinder liner and into the bore of the liner housing until longitudinally positioned under the lock dog;

rotating the collar nut in a rotational first direction to move the tapered surface of the locking sleeve longitudinally along the outer periphery of the lock dog to slide the lock dog toward the adapter ring;

engaging the lock dog with the adapter ring with an angled surface; and pushing the adapter ring longitudinally toward the cylinder liner and toward the liner housing.

11. The method of claim 10, wherein the outer periphery of the lock dog comprises a longitudinally tapered surface configured to slidably engage the longitudinally tapered surface of the locking sleeve and wherein rotating the collar nut in a first direction to move the tapered surface of the locking sleeve longitudinally comprises moving the tapered surface of the locking sleeve along the tapered surface of the lock dog.

12. The method of claim 10, wherein rotating the collar nut in the rotational first direction comprises moving the collar nut in a longitudinal first direction relative to the liner housing while moving the locking sleeve in the longitudinal first direction relative to the collar nut causing the locking sleeve to move faster relative to the liner housing than the collar nut.

* * * * *